US010415112B2

(12) United States Patent
Arlazarov

(10) Patent No.: US 10,415,112 B2
(45) Date of Patent: Sep. 17, 2019

(54) METHOD FOR PRODUCING A HIGH STRENGTH STEEL PIECE

(71) Applicant: ArcelorMittal, Luxembourg (LU)

(72) Inventor: Artem Arlazarov, Maizieres-les-Metz (FR)

(73) Assignee: ARCELORMITTAL, Luxembourg (LU)

( * ) Notice: Subject to any disclaimer, the term of this patent is extended or adjusted under 35 U.S.C. 154(b) by 290 days.

(21) Appl. No.: 15/322,869

(22) PCT Filed: Jul. 23, 2015

(86) PCT No.: PCT/IB2015/055580
§ 371 (c)(1),
(2) Date: Dec. 29, 2016

(87) PCT Pub. No.: WO2016/016779
PCT Pub. Date: Feb. 4, 2016

(65) Prior Publication Data

US 2017/0130291 A1 May 11, 2017

(30) Foreign Application Priority Data

Jul. 30, 2014 (WO) ..... PCT/IB2014/002342

(51) Int. Cl.

| | |
|---|---|
| ***C21D 9/46*** | (2006.01) |
| ***C21D 1/22*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C23C 2/02*** | (2006.01) |
| ***C21D 1/18*** | (2006.01) |
| ***C21D 1/26*** | (2006.01) |
| ***C21D 6/00*** | (2006.01) |
| ***C22C 38/34*** | (2006.01) |
| ***C22C 38/42*** | (2006.01) |

(Continued)

(52) U.S. Cl.

CPC ..... *C21D 9/46* (2013.01); *C21D 1/18* (2013.01); *C21D 1/22* (2013.01); *C21D 1/26* (2013.01); *C21D 6/004* (2013.01); *C21D 6/005* (2013.01); *C21D 6/008* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/34* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C23C 2/02* (2013.01); *C23C 2/06* (2013.01); *C23C 2/40* (2013.01); *C21D 9/573* (2013.01); *C21D 11/00* (2013.01); *C21D 2211/001* (2013.01); *C21D 2211/008* (2013.01)

(58) Field of Classification Search

CPC ..... B22F 2999/00; B22F 2201/013; B22F 1/0088; B22F 3/1055; B22F 2202/13; B22F 1/0081; B22F 2003/1056; B22F 2003/1057; B22F 2009/0828; B22F 2301/052; B22F 2301/205; B22F 2301/35; B22F 2302/45; B22F 2998/10; B22F 9/082; B01J 19/08; B01J 19/121; B01J 2219/0879; B01J 2219/0894; B01J 2219/12; B23K 2103/05; B23K 2103/10; B23K 2103/14; B23K 2103/50; B23K 26/125; B23K 26/126; B23K 26/342; B23K 26/70; B33Y 10/00; B33Y 30/00; B33Y 40/00; B33Y 80/00; C01B 33/02; Y02P 10/295

See application file for complete search history.

(56) References Cited

U.S. PATENT DOCUMENTS

2014/0322559 A1 10/2014 Becker et al.

FOREIGN PATENT DOCUMENTS

| | | |
|---|---|---|
| CN | 101812578 A | 8/2010 |
| EP | 2039791 A1 | 3/2009 |

(Continued)

OTHER PUBLICATIONS

Foejer C et al: "Industrial Production of Quenching and Partitioning Steel", 2013 Intl. Symposium on New Developments in AHSS, Jan. 1, 2013, pp. 167-174.

(Continued)

*Primary Examiner* — Jenny R Wu
(74) *Attorney, Agent, or Firm* — Davidson, Davidson & Kappel, LLC

(57) ABSTRACT

A method for producing a high strength steel piece having desired mechanical properties, obtainable by a reference heat treatment comprising a first reference treatment and a final reference treatment comprising at least an overaging, The method comprising a step of heat treating on an equipment comprising at least an overaging means for which it is possible to set at least one operating point, the final treatment comprising an overaging for which it is possible to calculate two final treatment parameters OAP1 and OAP2 depending on an operating point of the overaging means. A minimum OAP1 min and a maximum OAP2 max final treatment parameters are determined in order to obtain the desired properties, at least one operating points of the overaging section means is determined such that OAP1≥OAP1 min and OAP2≤OAP2 max. The piece is heat treated accordingly. The parameters are with T (t) the temperature at QT time t Formula (I).

15 Claims, 2 Drawing Sheets

(51) Int. Cl.

| | |
|---|---|
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |
| ***C23C 2/06*** | (2006.01) |
| ***C23C 2/40*** | (2006.01) |
| *C21D 9/573* | (2006.01) |
| *C21D 11/00* | (2006.01) |

(56) References Cited

FOREIGN PATENT DOCUMENTS

| | | | | | |
|---|---|---|---|---|---|
| EP | 2325346 | A1 | | 5/2011 | |
| EP | 2524970 | A1 | | 11/2012 | |
| EP | 2683839 | A1 | | 1/2014 | |
| JP | 54104419 | A | * | 8/1979 | ..... C21D 9/561 |
| WO | 2004022794 | A1 | | 3/2004 | |
| WO | 2012120020 | A1 | | 9/2012 | |
| WO | 2013010968 | A1 | | 1/2013 | |

OTHER PUBLICATIONS

Taejin Song et al: "On the Processing of Martensitic Steels in Continuous Galvanizing Lines: Part 1", Metallurgical and Materials Transactions A, Springer-Verlag, New York, vol. 43, No. 1, Nov. 15, 2011, pp. 245-262.

George Krauss: Microstructures Processing, and Properties of Steels, In: "ASM Metals Handbook, vol. 1", Mar. 1, 1990, ASM International, USA, pp. 126-139.

Lauralice C F Canale et al. "A Historic Overview of Steel Tempering Parameters", International Journal of Microstructure and Materials Properties: IJMMP, Geneve: Inderscience Enterprises, vol. 3, No. 4-5, Jan. 1, 2008, pp. 474-525.

* cited by examiner

METHOD FOR PRODUCING A HIGH STRENGTH STEEL PIECE

The present invention is related to the production of high strength steel pieces, in particular on a continuous annealing line.

In particular, in order to improve the energy efficiency of automotives, a weight reduction is required. This is possible by using steel pieces or sheets having improved yield strength and tensile strength to manufacture the body parts. Such steels must also have a good ductility in order to be easily formed.

For this purpose, it has been proposed to use pieces made of C—Mn—Si steels, heat treated so to have a structure containing at least martensite and retained austenite. The heat treatment comprises at least an annealing step, a quenching step and a carbon partitioning step. The annealing is performed at a temperature higher than the $Ac_1$ transformation point of the steel in order to obtain an at least partially austenitic initial structure. The quenching is performed by rapidly cooling down to a quenching temperature comprised between the Ms and Mf transformation temperatures of the initial at least partly austenitic structure, in order to obtain a structure containing at least some martensite and some retained austenite, the reminder being ferrite and/or bainite. Preferably, the quenching temperature is chosen in order to obtain the highest possible proportion of retained austenite considering the annealing temperature. When the annealing temperature is higher than the $Ac_3$ transformation point of the steel, the initial structure is fully austenitic and the structure directly resulting from the quench at the temperature between Ms and Mf, contains only martensite and residual austenite.

The carbon partionning (which will be called also "overaging" within the context of this invention) is performed by heating from the quench temperature, up to a temperature that is higher than the quenching temperature, and lower than the $Ac_1$ transformation temperature of the steel. This makes it possible to partition the carbon between the martensite and the austenite, i.e. to diffuse the carbon from martensite into austenite, without formation of carbides. The degree of partitioning increases with the duration of the overaging step. Thus, the overaging duration is chosen to be sufficiently long to provide as complete as possible partitioning. However, a too long duration can cause the decomposition of austenite and too high partitioning of martensite and, hence, a reduction in mechanical properties. Thus, the duration of the overaging is limited so as to avoid as much as possible the formation of ferrite.

Moreover, the pieces may be hot dip coated, which generates a further heat treatment. So, if the pieces have to be hot dip coated after the initial heat treatment, the effect of the hot dip coating has to be taken into account when the conditions of the initial heat treatment are determined.

The piece may be a steel sheet manufactured on a continuous annealing line, wherein the translation speed of the sheet depends on its thickness. As the length of the continuous annealing line is fixed, the duration of the heat treatment of a particular sheet depends on its translation speed i.e. on its thickness. Therefore, the conditions of the heat treatment and more specifically the temperature and the duration of the overaging have to be determined for each sheet not only according to its chemical composition but also according to its thickness.

As the thickness of the sheets can vary within a certain range, a very large number of tests must be performed to determine the conditions of heat treatment of the various sheets produced on a specific line.

Alternatively, the piece may also be a hot formed blank which is heat treated in a furnace after forming. In this case, the heating of the piece from the quenching temperature to the overaging temperature depends on the thickness and the size of the piece. Therefore, a large number of tests are also necessary to determine the conditions of treatment for the various pieces made of the same steel.

It is a purpose of the present invention to provide a means to reduce the number of tests that have to be performed in order to produce steel pieces manufactured from the same steel but having various thickness and size, with a specific equipment such that a particular annealing line or a particular furnace.

Therefore, the invention relates to a method for producing a high strength steel piece by heat treating the piece on an equipment comprising at least an overaging section or a furnace for which it is possible to set at least one operating point, in order to obtain desired mechanical properties for the sheet, the heat treatment comprising at least a final treatment comprising at least an overaging step, for which it is possible to calculate two final treatment parameters OAP1 and OAP2 depending at least on the at least operating point i.e. depending on the at least one operating point, wherein it is possible to set at least an operating point for the overaging section, characterized in that it comprises the steps of:

determining a minimum first final treatment parameter OAP1 min and a maximum second final treatment parameter OAP2 max respectively, in order to obtain the desired mechanical properties, determining at least the operating points of the overaging section such that the first final treatment parameter OAP1 and the second final treatment parameter OAP2 resulting from operating points fulfill:

$$OAP1 \geq OAP1\ \min$$

and $$OAP2 \leq OAP2\ \max$$

and heat treating the piece on the equipment running according to the determined operating points.

The method is a method for producing a high strength steel piece having desired mechanical properties, the piece being made of a steel for which it is known that it is possible to obtain said desired mechanical properties by a reference heat treatment comprising a first reference treatment conferring to the steel piece a defined structure and a final reference treatment comprising at least an overaging. Said method for producing a high strength steel piece comprises a step of heat treating the piece on an equipment comprising at least overaging means in order to obtain desired mechanical properties for the piece. The step of heat treating comprises at least a final treatment made on the steel piece having the same structure than the defined structure resulting from said first reference treatment. The final treatment comprises at least an overaging step made on said overaging means for which it is possible to set at least one operating point, for which it is possible to calculate two final treatment parameters OAP1 and OAP2 depending on said at least one operating point of the overaging means. The method comprises the steps of:

determining a minimum first final treatment parameter OAP1 min and a maximum second final treatment parameter OAP2 max respectively, in order to obtain the desired mechanical properties, determining at least the at least one operating points of the overaging section means such that the first final treatment parameter OAP1 and the second final treatment parameter OAP2 resulting from operating points fulfill:

$$OAP1 \geq OAP1\ \min$$

and $$OAP2 \leq OAP2\ \max$$

and heat treating the piece on the equipment running according to the determined operating points wherein, if T(t) is the temperature in ° C. of the steel piece at the time t, $t_0$ the time of the beginning of the final treatment and $t_f$ the time of the end of the final treatment:

the corresponding first overaging parameter OAP1 is:

$$OAP1 = \int_{t_0}^{t_f} \exp(-Q/R(T(t)+273))dt,$$

wherein

Q=activation energy of the diffusion of carbon

R=ideal gas constant, and the second overaging parameter OAP2 is:

$$OAP2 = a * T_0 + b * \left( \int_{t_0}^{t_f} T(t)^2\, dt \right)^{\frac{1}{2}}$$

$T_0$ being the temperature at time $t_0$.

According to other advantageous aspects of the invention, the method may comprise one or more of the following features, considered alone or according to any technically possible combination:

the desired mechanical properties are minimum values for at least a traction property such as the yield strength and/or the tensile strength and for at least a ductility property such as the total elongation and/or the uniform elongation and/or the hole expansion ratio and/or the bending properties, the first reference treatment comprise an annealing at a temperature higher than the Ac1 transformation point of the steel in order to obtain before quenching a structure containing at least 50% of austenite and a quenching down to a temperature QT lower than the Ms transformation point of the steel in order to obtain a structure comprising just after quenching at least martensite and austenite and the overaging is made at a temperature not less than the quenching temperature QT and lower than the Ac1 transformation point of the steel, the annealing is made at a temperature higher than Ac3 in order to obtain before quenching a structure fully austenitic, the quenching temperature QT is such that the structure resulting from the final treatment contains at least 10% of austenite, the overaging consists in heating said piece from the quenching temperature QT to an overaging temperature TOA lower than the Ac1 transformation temperature of the structure resulting from the quenching, a holding step at this temperature, the overaging having a duration tOA;

the heat treatment comprises, before the final treatment, an annealing at an annealing temperature AT higher than the Ac1 transformation temperature of the steel so to confer to the steel a partially or totally austenitic initial structure, a quenching step down to a quenching temperature QT lower than the Ms transformation temperature of the initial structure, in order to obtain a quenching structure containing at least martensite and retained austenite;

the final treatment comprises further to the overaging step, a hot dip coating step, for example a galvanizing or a galvannealing step, the steel piece is a steel sheet produced on a continuous line and the overaging means is an overaging section of a continuous annealing line, before entering in the overaging section, the sheet is annealed and quenched according to the first reference treatment, the sheet moves at a speed V, and the operating points which are determined comprise at least one of the following operating points: the speed of the sheet, the heat power and the overaging temperature;

the steel piece is the hot formed piece and the overaging means is a furnace in which the piece is maintained and in that, just before entering in the furnace, the structure of the hot formed piece is the same as the structure of the piece after the first reference treatment, the operating points which are determined comprise at least one of the following operating points: the holding duration of the piece in the furnace, the heat power and the overaging temperature;

to determine the minimum first final treatment parameter and maximum second final treatment parameter, a plurality of experiments are performed with overaging consisting in a very fast heating from the temperature QT up to a holding temperature Th preferably at a heating speed of more than 10° C./s, a holding step at the holding temperature Th for a plurality of durations tm and a very fast cooling down to the room temperature preferably at a cooling speed higher than 10° C./s but not too high so as not to form fresh martensite in the structure, to determine the minimum first final treatment parameter and the maximum second final treatment parameter, experiments are performed on a continuous annealing line, for example with a sheet having a thickness e, the chemical composition of the steel comprises in weight %:

0.1%≤C≤0.5%

0.5%≤Si≤2%

1%≤Mn≤7%

Al≤2%

P≤0.02%

S≤0.01%

N≤0.02% optionally one or more elements selected from Ni, Cr, Mo, Cu, Nb, V, Ti, Zr and B, the contents of which being such that:

Ni≤0.5%, 0.1%≤Cr≤0.5%, 0.1%≤Mo≤0.03%

Cu≤0.5%

0.02%≤Nb≤0.05%

Q=148 000 J/mol, R=8,314 J/(mol·K), time in seconds, a=b=0.016. These values make it possible to calculate the reduction of yield strength of the final structure, expressed in MPa.

The invention will now be described in more details but without limitations in view of the following drawings wherein.

Figure 1:
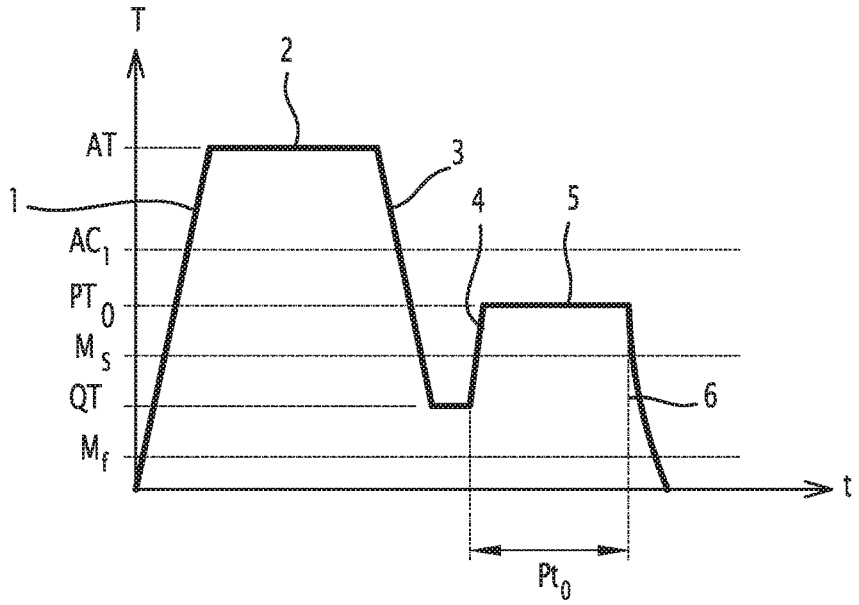
FIG. 1 is a schematic time/temperature curve for a heat treatment schedule—performed on a laboratory equipment.

In the art, it is well known that when a skilled person who wishes to manufacture a piece made of steel having desired properties, he knows how to choose a suitable steel and a heat treatment able to confer to the steel the wished properties. But he has to adapt the heat treatment to each particular piece and to the equipment that will be used to manufacture the piece.

If the piece is a sheet to be produced on a continuous line, the equipment is for example a continuous annealing line known per se, comprising at least an overaging section. If the sheet has to be hot dip coated, the equipment comprises moreover at least hot dip coating means which can be separate from the continuous annealing line or included in the continuous annealing line.

If the piece is produced by hot forming and heat treating, the equipment comprises at least overaging furnaces.

In all cases, the overaging means are furnaces for which as it is well known in the art, set points are fixed. These set points are for example one or more temperature, heating power, duration of the staying of the piece in the furnace, translation speed of the sheet for a continuous line, and so on. For each equipment, those who are skilled in the art know which set points have to be fixed and how to determine the value that must be fixed to these set points in order to achieve a particular heat treatment defined by a themal cycle suffered by the piece.

As previous said, it is the purpose of the present invention to propose to a skilled person who which to produce a particular piece having desired properties and who know which steel to use with which type of heat treatment, particularly a quenching and partitioning treatment, a method by which he can determine easily how to achieve a suitable heat treatment for the piece using a particular equipment.

The high strength formable steel pieces manufactured by annealing, partial quenching and overaging on continuous annealing lines are often made from steels containing in weight %:

- 0.1%≤C≤0.5%. Carbon content not less than 0.1% is necessary for ensuring a satisfactory strength and for stabilizing the retained austenite that is necessary to obtain a good formability. If the carbon content exceeds 0.5%, the weldability is insufficient.
- 0.5%≤Si≤2% to stabilize the austenite, to provide solid solution strengthening and to retard the formation of carbides during overaging. When Si content exceeds 2%, silicon oxides may occur at the surface of the sheet, which is detrimental for coatability.
- 1%≤Mn≤7% for having a sufficient hardenability so as to obtain a structure with sufficient martensite proportion, and so to stabilize the austenite thus promoting its stabilization at room temperature. For some applications, the Mn content is preferably less than 4%.
- Al≤2%—at low contents (less than 0.5%), aluminum is used for deoxidizing the steel. At higher contents, Al retards the formation of carbides, which is useful for carbon partitioning into austenite and for obtaining a high proportion of retained austenite in the structure. Preferably, the Al content should be not less than 0.001% for avoiding costly materials selection.
- P≤0.02%—Phosphorus may reduce the carbides formation and thereby promote the redistribution of carbon into austenite. However, too high phosphorus content embrittles the sheet at hot rolling temperatures and reduces the martensite toughness. Preferably, the P content should not be lower than 0.001% to avoid costly dephosphorization treatments.
- S≤0.01%. Sulfur content must be limited since it may embrittle the intermediate or final product. Preferably, the S content should not be lower than 0.0001% to avoid costly desulfurization treatments.
- N≤0.02%. This element results from the elaboration. Nitrogen can combine with aluminum to form nitrides which limit the coarsening of austenite grain size during annealing. Manufacture of steels with N content below 0.001% is more difficult and does not provide additional benefit.
- optionally the steel may contain: Ni≤0.5%, 0.1%≤Cr≤0.5%; 0.1%≤Mo≤0.3% and Cu≤0.5%. Ni, Cr and Mo are able to increase the hardenability which makes it possible to obtain the desired structures in the production lines. However, these elements are costly and therefore, their contents are limited. Cu, often present as residual element, is able to harden the steel and can reduce the ductility at hot rolling temperatures when present in too high content.
- optionally 0.02%≤Nb≤0.05%, 0.02%≤V≤0.05%, 0.001%≤Ti≤0.15%, 0.002%≤Zr≤0.3%. Nb can be used to refine austenitic grain during hot rolling. V may combine with C and N to form fine strengthening precipitation. Ti and Zr can be used to form fine precipitates in ferritic components of the microstructure thus increasing the strength. Moreover, if the steel contains B, Ti or Zr can protect boron from being bound with N. The sum Nb+V+Ti+Zr/2 should remain lower than 0.2% in order not to deteriorate the ductility.
- optionally 0.0005%≤B≤0.005%. Boron may be used to improve hardenability and to prevent the formation of ferrite on cooling from fully austenitic soaking temperature. Its content is limited to 0.005% because above this level further addition is ineffective.

The remainder of the composition is Fe and unavoidable impurities resulting from elaboration. This composition is given as an example of the most used steels but is not limitative.

With such steel, pieces such as rolled sheets or hot stamped pieces are produced and heat treated in order to obtain the desired properties such as yield strength, tensile strength, uniform elongation, total elongation, hole expansion ratio, bending properties and so on. These properties depend on the chemical composition and on the micrographic structure resulting from the heat treatment.

For the sheets which are considered in the present invention, the desired structure i.e. the final structure after full heat treatment has to contain at least martensite and residual austenite, the remainder being ferrite and optionally some bainite. Generally, the martensite content is of more than 10% and preferably of more than 30% and the residual austenite is of more than 5% and preferably of more than 10%.

As explained previously, this structure results from a heat treatment comprising an annealing step so to obtain an initial totally or partially austenitic structure, a partial quenching (i.e. a quenching at a temperature between Ms and Mf)

immediately followed by an overaging, and optionally followed by a dip coating step i.e. a hot dip coating step. The proportion of ferrite results from the annealing temperature. The proportion of martensite and residual austenite results from the quenching temperature, i.e. the temperature at which the quenching is stopped. Those skilled in the art know how to determine either by laboratory trials or by calculations, the structure and the mechanical properties resulting from a heat treatment, the time/temperature curve of which is displayed at FIG. 1. This heat treatment consists of:

a heating step (1) up to an annealing temperature AT, higher than the Ac1 transformation point of the steel, i.e. the temperature at which austenite starts to appear on heating, preferably the annealing temperature is chosen such that the structure at the annealing temperature contains at least 50% of austenite, and is often higher than the Ac3 transformation point in order to obtain a full austenitic structure and, preferably, this annealing temperature is less than 1050° C. in order to not coarsen too much the grain size of the austenite, a holding step (2) at this temperature, a quenching step (3) down to a quenching temperature QT comprised between the Ms (martensite start) and Mf (martensite finish) transformation temperature of the austenite resulting from the annealing in order to obtain just after quenching a structure comprising martensite and residual austenite; for that, the quenching has to be made at a cooling speed sufficient to obtain a martensitic transformation, those which are skilled in the art know how to determine such cooling speed, a final heat treatment which in this case consists of a rapid heating up (4) up to an overaging temperature PTo, a holding step (5) at this temperature during a time Pto and a cooling step (6), down to the room temperature. In this case, the rapid heating can range from 10 to 500° C./s for example.

Preferably, the quenching temperature is chosen such that the structure just after quenching contains at least 10% of martensite and at least 5% of austenite. When the annealing temperature is higher than the Ac3 transformation point of the steel i.e. the structure at the annealing temperature is completely austenitic, the quenching temperature is preferably chosen such that the structure just after quenching contains at least 10% of austenite and at least 50% of martensite.

Those who are skilled in the art know how to determine for each steel the annealing conditions (annealing temperature and holding duration), and the quenching conditions (quenching temperature and cooling speed) with which it is possible to obtain a desired structure. They know also how to determine a reference final heat treatment and the mechanical properties which are obtained by such treatment. Therefore, for each particular steel, those which are skilled in the art are able to determine which levels of mechanical properties are obtainable by such heat treatments. The mechanical properties are for example traction properties such as yield strength and tensile strength or ductility properties such as total elongation, uniform elongation, hole expansion ratio, bending properties. But, as the actual heat treatment conditions of a particular product such as a sheet or a piece which is produced on a particular production equipment are not always identical to the reference heat treatment, the manufacturing conditions of each particular product on each particular production equipment have to be adapted accordingly.

In order to determine the manufacturing conditions i.e. the heat treatment conditions on a particular continuous annealing line after rolling or in a particular furnace after hot forming such as hot stamping, able to reach the desired mechanical properties, experiments are performed for example using a laboratory equipment (thermal simulator) for reproducing heat treatments as defined above, in order to determine a reference heat treatment able to obtain the desired properties. This reference heat treatment is defined by an annealing temperature AT, a quenching temperature QT, an overaging temperature $PT_0$, and a holding duration Pto at this overaging temperature.

Laboratory devices able to implement such thermal treatments, known as thermal simulators, are well known by those skilled in the art.

As explained previously the effect of the final heat treatment at temperature PTo is to partition the carbon into the austenite. This partitioning results in the transfer by diffusion of the carbon from martensite, into the austenite phase. This transfer depends on the temperature and on the holding duration. For a heat treatment corresponding to a holding during a time t at a temperature T, i.e. an ideal "rectangular" thermal cycle, the efficiency can be estimated by a first final treatment parameter OAP1 equal to the product of the diffusion coefficient of the carbon at the holding temperature D(T) by the holding duration t:

$$OAP1=D(T)\times t \quad (1)$$

The higher the parameter value is, the more advanced the partitioning is and, usually, the ductility properties such as total or uniform elongation or hole expansion ratio are improved or not deteriorated.

Moreover, during the final treatment, the yield strength of the martensite decreases from a value $YS_0$ before final treatment, to a value $YS_{ova}$ after final treatment which depends on thermal cycle of the final treatment. The inventors have determined that the yield strength $YS_0$ of the fresh martensite, i.e. the martensite not having being submitted to a further heat treatment, can be evaluated from the chemical composition of the steel by the following formula:

$$YS_0=1740*C*(1+Mn/3.5)+622 \quad (2)$$

wherein $YS_0$ is expressed in MPa, and C and Mn are the carbon and manganese contents of the steel expressed in % in weight.

The inventors have also newly noticed that, for a thermal cycle consisting in a holding step at a temperature T during a duration t, the yield strength i.e. the yield strength of the martensite after final treatment can be calculated by the formula:

$$YS_{ova}=YS_0-0.016*T*(1+\sqrt{t}) \quad (3)$$

with T: holding temperature, in ° C.

t: holding duration at the temperature T, in seconds

With this formula, it is possible to determine a second final treatment parameter OAP2, which is, for a rectangular thermal cycle:

$$OAP2=YS_0-YS_{ova}=0.016*T*(1+\sqrt{t}) \quad (4)$$

As the yield strength of the structure consisting of various constituents such as martensite and austenite, results from the yield strengths of these constituents, the higher the parameter OAP2, the higher the yield strength reduction of the final structure.

As it is essentially the yield strength of the martensite which is affected by the partitioning, the effect of the partition of the carbon on the yield strength of a structure containing significant other constituent than martensite, for example austenite and ferrite, depends on the proportion of martensite in the structure. In this case, if M % is the proportion of martensite in the structure in % and if it may be considered that only the proportional effect of the martensite must be considered, the reduction of yield strength of the structure is OAP2×(M %/100).

It is generally desired that the partitioning which results from the heat treatment is at least sufficient to obtain good ductility properties and preferably the most advanced as possible and that the yield strength remains sufficiently high.

Therefore, instead of determining a reference treatment, it is possible to determine a minimum first final treatment parameter OAP1 min and a maximum second final treatment parameter OAP2 max, such that a heat treatment corresponding to these parameters gives the desired properties to the sheet. And it is considered that the actual heat treatments used to manufacture sheets may correspond to a first overaging parameter OAP1 higher than the minimal first final treatment parameter OAP1 min and to a second overaging parameter OAP2 lower than the maximal second final treatment parameter OAP2 max.

It could be noted that the two parameters OAP1 and OAP2 depends only on the time/temperature schedule of the heat treatment and does not represent properties of the steel.

To determine the first and second final treatment parameters, it is possible to proceed as follow. Heat treatments consisting on an annealing, a quenching to a quenching temperature and an overaging are made using a thermal simulator well known in the art. The annealing and the quenching correspond to the reference treatment and are such that the wished structure is obtained. The overaging is a rectangular (or about rectangular) thermal cycle consisting on a heating from the quenching temperature to a holding temperature Toa quickly at a heating speed of at least 10° C./s, a holding at this temperature for a durations $t_{hol}$ and a cooling to the room temperature at a cooling speed of at least 10° C./s but not too high so as not to form fresh martensite. Those which are skilled in the art know how to determine such cooling speed. A plurality of treatments is made with different holding durations $t_{hol}1$, $t_{hol}2$, $t_{hol}3$ for example, and the mechanical properties are measured. With these results the minimum holding duration necessary to obtain the wished ductility properties is determined $t_{hol}$ min and the maximum holding duration $t_{hol}$ max for which the yield strength remains higher than the minimal wished value YSmini is determined. Those which are skilled in the art know how to determine these maximum and minimum holding durations. Then the minimal first and maximal second final heat treatment parameters are determined as follow:

$$OAP1\ \min = D(Toa) \times t_{hol}\ \min$$

$$OAP2\ \max = YS_0 - YS\mathrm{mini} = 0.016 * Toa * (1 + t_{hol}\ \max^{1/2})$$

or, if the martensite content M % must be considered:

$$OAP2\ \max = YS_0 - YS\mathrm{mini} = 0.016 * Toa * (1 + t_{hol}\ \max^{1/2})/(M\ \%/100)$$

Therefore, after having determined the annealing temperature, the quenching temperature, the minimum first final treatment parameter OAP1 min and the maximum second final treatment parameter OAP2 max, the conditions of the final treatment for the actual heat treatment of a given steel piece which is performed in industrial conditions on a particular equipment (such as particular continuous annealing line or particular furnace) can be determined, the annealing temperature and the quenching temperature being equal to those that were determined previously.

For the final treatment in industrial conditions, it should be noted that the thermal cycle is not rectangular but comprises a progressive temperature increase up to a maximum value, then maintaining at this value, this step being generally followed by a cooling to the room temperature. The shape of the thermal cycle depends on the operating points of the equipment that are used to implement the final treatment, and of the geometrical characteristics of the product which is treated. For a sheet, the geometrical characteristics are thickness and width. Those skilled in the art know which parameters have to be considered, according to the characteristics of the product.

Figure 2:
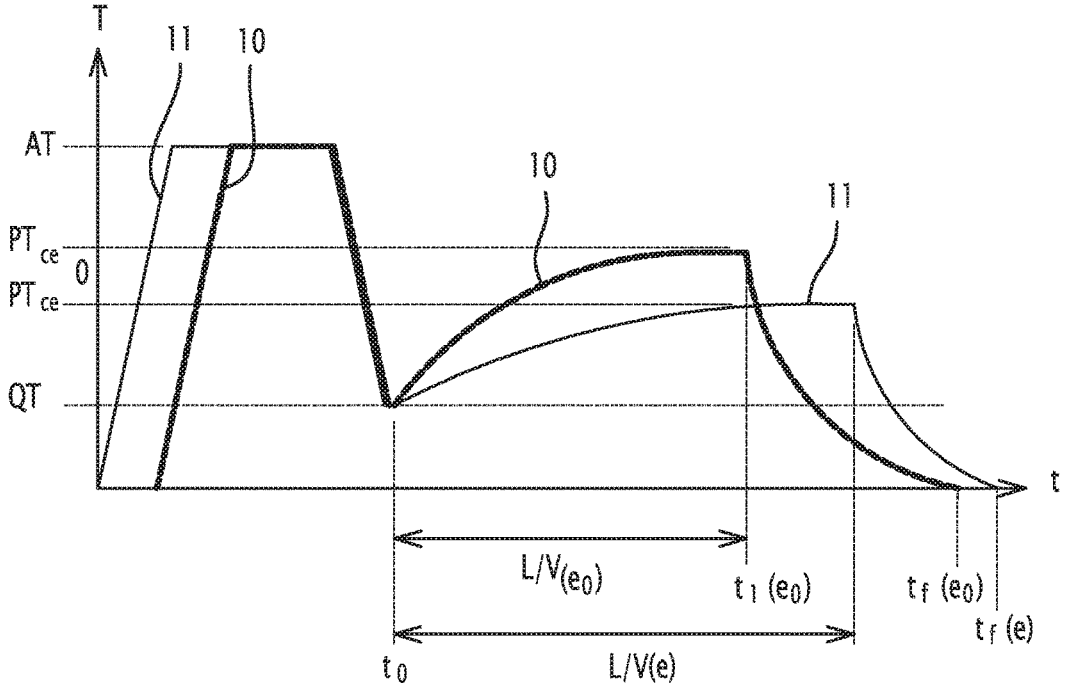
FIG. 2 are schematic time/temperature curves for heat treatments of two sheets having different thickness, performed on a continuous annealing line without hot dip coating.

For example, if the sheet is produced on a continuous annealing line without hot dip coating, the final treatment is an overaging, the total duration of which depends on the translation speed of the sheet, which depends on the thickness of the sheet as it is known by those skilled in the art. The thicker the sheet, the lower the speed, i.e. the longer is the holding duration of the overaging step. Such thermal cycles are shown at FIG. 2. On this figure, a first curve (10) displays the thermal cycle for a first sheet having a thickness $e_0$. The temperature increase after quenching at temperature QT, starts at the time $t_0$ and the holding step ends at time $t_1$ $(e_0)$. The duration of the overaging step $(t_1\ (e_0)-t_0)$ is equal to the length L of the overaging section of the continuous annealing line, divided by the translation speed $v(e_0)$ of the sheet: $(t_1(e_0)-t_0)=L/v(e_0)$.

On the same figure, a second curve (11) displays the thermal cycle for a second sheet having a thickness e which is higher than $e_0$. For the sake of comparison, the time at which partitioning starts from the temperature QT, has been coincided for the first and second curves. Thus, the thermal cycle starts at the time $t_0$ and ends at time $t_1$ (e) which occurs after the time $t_1$ $(e_0)$ because, as the thickness e of the sheet is higher than $e_0$, the translation speed v(e) is lower than the translation speed $v(e_0)$ of the first sheet.

The portion of the curves corresponding to the heating stage depend on the heating power of the overaging section of the continuous annealing line, on the thickness and the width of the sheet and on its translation speed. The maximum temperature which is reached by the sheet and at which the sheet is held at the end of the overaging is defined by the set point for the furnace temperature of the overaging section.

Those skilled in the art know how to calculate the (temperature/time) curve, as from time $t_0$, corresponding to a sheet having given thickness and width, for given translation speed, heating power and set point temperature of the overaging section.

This is also the same for a blank cut from the sheet. Those skilled in the art know how to calculate the theoretical (temperature/time) curve for a blank having a given thickness and size, for given holding duration in a furnace and operating points such as heating power and set point temperature.

In order to determine the first and second final treatment parameters OAP1 and OAP2 which are characteristic of an actual final treatment, it can be noted that the first final treatment parameters OAP1 corresponding to two rectangular thermal cycles are additive, i.e. that the first final treatment parameter of a final treatment corresponding to the application of two rectangular cycles is equal to the sum of the two corresponding first final treatment parameters. Therefore it is possible to calculate the first final treatment parameter OAP1 by integrating the parameter throughout the thermal cycle. Thus, if t stands for the time, $t_0$ is the start time of the final treatment cycle, $t_1$ is the end time of it, and T(t) the temperature of the sheet at time t, the first final treatment parameter OAP1 of the cycle is:

$$OAP1=\int_{t_0}^{t_1} \exp(-Q/R(T(t)+273))dt \quad (5)$$ with:

R=8,314 J/(mol·k)

Q=activation energy of the diffusion of carbon. For a steel having the preferable composition according to the invention, Q=148000 J/mole.

T=temperature in ° C.

In this formula, $t_0$ and $t_1$ can be chosen according to the particular conditions, i.e. $t_0$ may be for example the beginning of the heating or the beginning of the holding, and $t_1$ may be for example the end of the holding or the end of the cooling to the room temperature. Those skilled in the art know how to choose $t_0$ and $t_1$ according to the circumstances.

More simply, the formula can be written:

$$OAP1=\int_{t_0}^{t_f} \exp(-Q/R(T(t)+273))dt$$

In which, $t_f$ is the end time of the treatment cycle which is considered.

As it is possible to calculate the thermal cycle T(t) from the speed of the sheet, the heating power and the set point for the overaging temperature, it is possible to determine the heating power and the set point for the final treatment temperature such that:

$$OAP1>OAP1 \text{ min.}$$

In the same manner, it is necessary to calculate the OAP2 parameter of any thermal cycle. For this purpose, it must be considered that for a rectangular cycle, $T_0$ being the initial temperature i.e. the temperature at which the piece is quickly heated at the beginning of the cycle, OAP2 can be calculated as follows:

$$(OAP2-a*T_0)^2=(YS_0-YS_{ova}-a*T_0)^2=b^2*T^2*t \quad (6)$$

wherein a=b=0.016 if YS is in MPa, T in ° C. and t in seconds.

As for a rectangular cycle, $T=T_0$, this formula is completely equivalent to the formula (3). But, contrary to the formula (3) which is not integrable, it is possible to use it to calculate OAP2 for any cycle.

The effects of two successive holding durations periods $t_1$ and $t_2$ at two temperatures $T_1$ and $T_2$ are cumulative and the quantities $(OAP2-a*T_0)^2$ corresponding to the sum of the two holding is equal to the sum of the quantities $(OAP2-a*T_0)^2$ of each holding period:

$$[OAP2((t_1 \text{ at } T_1)+(t_2 \text{ at } T_2))-a*T_0]^2=[OAP2(t_1 \text{ at } T_1)-a*T_0]^2+[OAP2(t_2 \text{ at } T_2)-a*T_0]^2$$

Thus, it is possible to calculate the second final treatment parameter of a final treatment corresponding to any particular thermal cycle since the thermal cycle is known.

If T(t) is the temperature T at the time t, and if $t_0$ and $t_f$ are respectively the initial and final time of the cycle, it is possible to calculate:

$$(OAP2-a*T_0)^2 = b^2 * \int_{t_0}^{t_f} T(t)^2 dt \quad (7)$$

And the parameter OAP2 is:

$$OAP2 = a*T_0 + b*\left(\int_{t_0}^{t_f} T(t)^2\, dt\right)^{\frac{1}{2}} \quad (8)$$

In this formula, $T_0$ is the temperature at $t=t_0$.

These parameters depend only from the actual temperature/time schedule of the heat treatment As for a particular sheet or piece which is heat treated on a particular equipment this temperature/time schedule depends directly from the operating points of that equipment and from the geometry of the sheet or piece. Those skilled in the art know how to calculate the operating points such as the heating power and the set point temperature such that:

$$OAP1 \geq OAP1 \text{ min and.} OAP2 \leq OAP2 \text{ max.}$$

It could be noted that, when the treatment is made using a continuous line in which a sheet is in translation, those which are skilled in the art know that the translation speed of the sheet and the thickness and eventually the width of the sheet have to be considered.

For a sheet manufactured on a continuous annealing line, when the parameters for the heat treatment, i.e. the translation speed of the sheet, the annealing temperature, the quenching temperature, the heating power and the set point overaging temperature are determined, the sheet is manufactured accordingly.

When the sheet is hot dip coated after the overaging, the final treatment comprises the coating and the thermal cycles corresponding to the coating must be taken into account.

Figure 3:
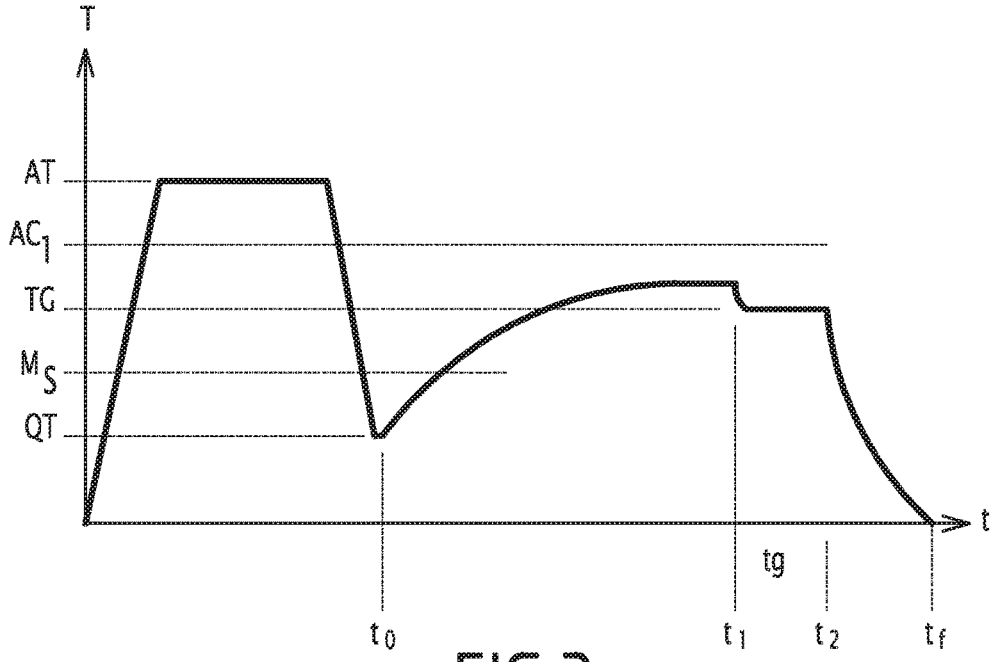
FIG. 3 is a time/temperature curve for a heat treatment of a sheet, performed on a continuous line comprising a galvanizing step.

For example, when the sheet is galvanized after the overaging, the sheet is maintained at a temperature of galvanizing $T_G$, generally, this temperature is of about 470° C., during a time tg generally between 5 s and 15 s (see FIG. 3).

In this case, it is possible to calculate the first and second final treatment parameters OAP1 and OAP2 corresponding to the whole thermal cycle after time $t_0$, i.e. including the coating and optionally the cooling to the ambient temperature, and it is these parameters that have to be considered. The heating power and set point overaging temperature have to be such that:

OAP1 (overaging step and coating step) OAP1 min

OAP2 (overaging step and coating step) OAP2 max

Figure 4:
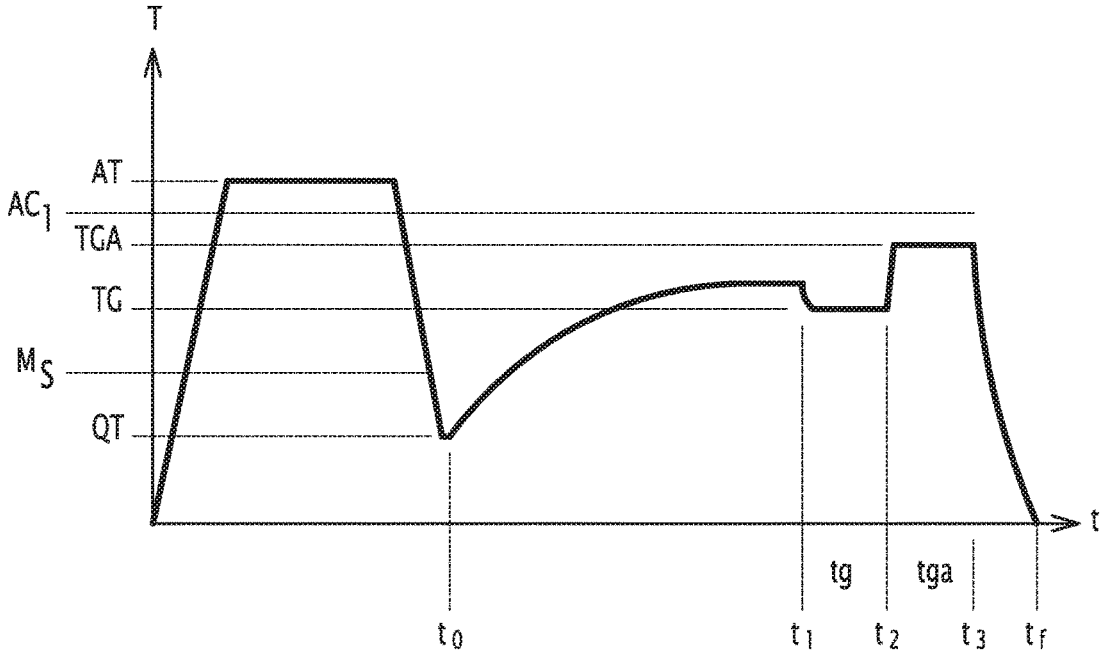
FIG. 4 is a time/temperature curve for a heat treatment of a sheet made on a continuous line comprising a further galvannealing step.

Optionally, the steel sheet can be galvannealed, i.e. submitted to a thermal cycle after galvanizing that causes iron diffusion into the zinc coating. The corresponding cycle (see FIG. 4) comprising a holding step at temperature Tg with a duration $t_g$, and a subsequent holding step at temperature $T_{ga}$ with a duration $t_{ga}$, These holding steps at temperature Tg and $T_{ga}$ have to be considered for the calculations of OAP1 and OAP2 according to the expressions (5) and (8) above.

In the previous embodiment of the invention, the characteristics of the heat treatment are determined on the basis of laboratory tests. However, according to another embodiment of the invention, it is also possible to determine a reference heat treatment from test with a sheet having a thickness $e_0$, on an actual continuous annealing line. By these tests, optionally completed by laboratory tests, it is possible to determine the annealing temperature, quenching temperature and the minimal first and maximal second overaging parameters. Thus, it is possible to determine the settings of the continuous annealing line for sheets of any thickness.

The method which has been just described relates to the heat treatment performed on a continuous annealing line. But those skilled in the art are able to adapt the method to any other process of manufacturing of such sheet or piece.

As an example, it has been determined, through laboratory experiments, that it was possible to obtain a yield strength of more than 1100 MPa, a tensile strength of more than 1300 MPa, a total elongation of at least 12% on a steel sheet containing 0.21% C, 2.2% Mn, 1.5% Si, with a heat treatment consisting on an annealing at 850° C. (>Ac3), a quenching temperature of 250° C. and a rapid heating up to an overaging step at a temperature of 460° C. for a duration time of at least 10 s. The structure of the steel consists of martensite and about 10% of retained austenite. Experimental examples were determined for three different partitioning times: 10 s, 100 s and 300 s. The conditions, the structures and the mechanical properties resulting from the treatments are reported in table I.

On the basis of laboratory experiments the final treatment parameters OAP1 and OAP2 can be determined for each partitioning time using the following equations:

$$OAP1\ \text{exp.}=[\exp(-148000/(8.314*(460+273)))]*t$$

$$OAP2\ \text{exp.}=(0.016*460)+(0.016*460*t^{0.5})$$

The obtained values of OAP1 exp. and OAP2 exp. are also reported in table I.

The results show that with a heat treatment corresponding to the test 1, the wished properties are obtained. As this test has the lowest parameter OAP1, it means that the corresponding value of the parameter can be chosen as OAP1 mini.

The value of OAP1 min, determined on the basis of laboratory experiments is:

$$OAP1\ \text{min.}=[\exp(-148000/(8.314*(460+273)))]*10=2.84*10^{-10},$$

According to the formula (2), the yield strength of the fresh martensite $YS_0$ is:

$$YS_0=1740*0.21*(1+2.2/3.5)+622=1217\ \text{MPa}.$$

In this case, as the structure contains about 90% of martensite, it can be considered and the maximal second final treatment parameter OAP2 max is:

$$OAP2\ \text{max}=1217-1100=117.$$

This value is higher than the parameter OAP2 exp. of the examples 1 and 2 but lower than that of the example 3. The yield strength obtained with the experimental treatments 1 and 2 is higher than 1100 MPa, Examples 1 and 2 respect the condition OAP2<117, however, on the contrary, example 3 shows a value of OAP2 higher than 117 and hence the yield strength does not reach the value of 1100 MPa.

Finally, implementing overaging cycles fulfilling: $OAP1 \geq 2.84*10^{-10}$, and OAP2<117, makes it possible to reach the desired mechanical properties for the investigated composition.

TABLE 1

| Test | AT (° C.) | QT (° C.) | Overaging temperature (° C.) | Duration time at overaging temperature (s) | Structure | YS (MPa) | TS (MPa) | TE % | OAP1 exp. | OAP2 exp. |
|---|---|---|---|---|---|---|---|---|---|---|
| 1 | 850 | 270 | 460 | 10 | M + 12% A | 1186 | 1304 | 12.9 | $2.84 * 10^{-10}$ | 30.6 |
| 2 | 850 | 270 | 460 | 100 | M + 11% A | 1141 | 1284 | 13.1 | $2.84 * 10^{-9}$ | 81 |
| 3 | 850 | 270 | 460 | 300 | M + 9% A | 1054 | 1283 | 10.5 | $8.51 * 10^{-9}$ | 134.8 |

For example, we consider two sheets, one having a thickness of 0.8 mm, the other of 1.2 mm to be manufactured on a continuous line having an overaging section comprising a first portion for a first heating and a second portion for a second heating. For each portion of the overaging section set points corresponding to the temperature at which the sheet is heated in said section have to be determined. Moreover, the running speed of the sheet is defined such that, when the thickness is 0.8 mm, the time during which a portion of the sheet is maintained in the first portion is 50 s and in the second portion is 100 s, when the thickness is 1.2 mm, the time in the first portion is 70 s and in the second portion is 140 s.

With these conditions one can easily calculate that, for the sheet having a thickness of 1.2 mm, the set points can be for the first portion 290° C. and for the second section 390° C., and for the sheet having a thickness of 0.8 mm, the set points can be for the first portion 350° C. and for the second portion 450° C. With such set points, the parameters are such that OAP1>OAP1 min.=$2.84*10^{-10}$ and OAP2≤OAP2 max=117. More precisely, for the sheet having a thickness of 1.2 mm, OAP1=$3.07*10^{-10}$ and OAP2=117, and for the sheet having a thickness of 0.8 mm, OAP1=$2.04*10^{-9}$ and OAP2=117.

When theses set points are determined, the sheets can be produced on the line running accordingly.

According to another example, we consider two sheets, one having a thickness of 0.8 mm, the other of 1.2 mm to be manufactured on a continuous line having an overaging section comprising a portion for a heating and a galvannealing section comprising a galvanizing section at a temperature of galvanizing $T_G$=470° C., and an alloying section at a temperature $T_{ga}$=520° C. For the reference treatment, the overaging temperature is 460° C. and the time at the overaging temperature is 220 s. For the overaging section, the galvanizing section and the alloying section, set points corresponding to the temperature at which the sheet is heated in said section have to be determined. Moreover, the running speed of the sheet is defined such that, when the thickness is 0.8 mm, the time during which a portion of the sheet is maintained in the overaging section is 270 s, the time during which a portion of the sheet is maintained in the galvanizing section is 8 s and the time during which a portion of the sheet is maintained in the alloying section the second portion is 25 s. When the thickness is 1.2 mm, the time in the overaging section is 180 s, the time in the galvanizing section is 5 s and the time in the alloying section is 15 s.

With these conditions one can easily calculate that, for the sheet having a thickness of 1.2 mm, the set point can be for the overaging section 480° C., so that OAP1=$1.26 \cdot 10^{-8}$ and OAP2=117, and for the sheet having a thickness of 0.8 mm, the set point can be for the overaging portion 410° C., so that OPA1=$6.06 \cdot 10^{-9}$ and OAP2=117.

The invention claimed is:

1. A method for producing a high strength steel piece having desired mechanical properties, comprising determining a reference heat treatment able to obtain the desired mechanical properties, the reference heat treatment including a first reference treatment conferring to a steel piece a defined structure and a final reference treatment comprising at least an averaging, the reference heat treatment being defined by an annealing temperature AT, a quenching temperature QT, an averaging temperature PTo and a holding duration Pto at the averaging temperature;

said method for producing a high strength steel piece comprising a step of heat treating a steel piece on an equipment including at least averaging means in order to obtain the desired mechanical properties for the high strength steel piece, the step of heat treating including at least a final treatment made on a steel having a structure similar to the defined structure resulting from said first reference treatment, the final treatment including at least an averaging step made on said averaging means for which it is possible to set at least one operating point, for which it is possible to calculate two final treatment parameters OAP1 and OAP2 depending on said at least one operating point of the averaging means, wherein the steel piece is a steel sheet produced on a continuous line and the averaging means is an averaging section of a continuous annealing line, and before entering in the averaging section, the sheet is annealed at the annealing temperature AT of the first reference treatment and quenched to the quenching temperature OT of the first reference treatment, the sheet moving at a speed V;

and the method comprises the steps of:

determining a minimum first final treatment parameter OAP1 min and a maximum second final treatment parameter OAP2 max respectively, in order to obtain the desired mechanical properties, by performing a plurality of experiments with overagings consisting in a heating from the quenching temperature OT up to a holding temperature Th at a heating speed of more than 10° C./s, a holding step at the holding temperature Th for a plurality of durations tm and a cooling down to the room temperature at a cooling speed higher than 10° C./s and selected so as not to form untempered martensite in the structure of the sheet, determining the at least one operating point of the overaging section such that the first final treatment parameter OAP1 and the second final treatment parameter OAP2 resulting from the at least one operating point fulfill:

$$OAP1 > OAP1\ \text{min and}$$

$$OAP2 < OAP2\ \text{max},$$

the operating points which are determined comprising at least one of the following operating points: the speed V of the sheet, a heat power and the overaging temperature, and heat treating the piece on the equipment according to the determined operating points, wherein, if T(t) is the temperature in ° C. of the steel sheet at the time t, to the time of the beginning of the final treatment and $t_f$ the time of the end of the final treatment: the corresponding first overaging parameter OAP1 is $$OAP1 = \int_{t_0}^{t_f} \exp(-Q/R(T(t)+273))dt,$$

wherein Q=activation energy of the diffusion of carbon and R=ideal gas constant, and the second averaging parameter OAP2 is:

$$OAP2 = a * T_0 + b * \left( \int_{t_0}^{t_f} T(t)^2\, dt \right)^{\frac{1}{2}}$$

$T_0$ being the temperature at time $t_0$, wherein Q=148000 J/mol, R=8.314 J/(mol·K), a=b=0.016 and t is in seconds.

2. The method according to claim 1, wherein the desired mechanical properties are minimum values for at least a traction property and for at least a ductility property.

3. The method according to claim 1, wherein the first reference treatment comprises an annealing at a temperature higher than the Ac1 transformation point of the steel in order to obtain, before quenching, a structure containing at least 50% of austenite, and a quenching down to the quenching temperature QT lower than the Ms transformation point of the steel in order to obtain a structure comprising just after quenching at least martensite and austenite, and the overaging is made at a temperature not less than the quenching temperature QT and lower than the Ac1 transformation point of the steel.

4. The method according to claim 3, wherein the annealing is made at a temperature higher than Ac3 in order to obtain before quenching a structure fully austenitic.

5. The method according to claim 3, wherein the quenching temperature QT is such that the final treatment results in a structure containing at least 10% of austenite.

6. The method according to claim 1, wherein the final treatment comprises further to the overaging step, a hot dip coating step.

7. The method according to claim 1, wherein, to determine the minimum first final treatment parameter and the maximum second final treatment parameter, the experiments are performed on a continuous annealing line.

8. The method according to claim 1, wherein the steel has a chemical composition comprising in weight %:

0.1%≤C≤0.5%;
0.5%≤Si≤2%;
1%≤Mn≤7%;
Al≤2%;
P≤0.02%;
S≤0.01%;
N≤0.02%;

optionally one or more elements selected from Ni, Cr, Mo, Cu, Nb, V, Ti, Zr and B, the contents of which being such that:

Ni≤0.5%;
0.1%≤Cr≤0.5%;
0.1%≤Mo≤0.03%;
Cu≤0.5%;
0.02%≤Nb≤0.05%;
0.02%≤V≤0.05%;
0.001%≤Ti≤0.15%;
0.2%≤Zr≤0.3%;
0.0005%≤B≤0.005%;
with: Nb+V+Ti+Zr/2≤0.2%; and
a remainder being Fe and unavoidable impurities.

9. A method for producing a high strength steel piece having desired mechanical properties, comprising determining a reference heat treatment able to obtain the desired mechanical properties, the reference heat treatment comprising a first reference treatment conferring to a steel piece a defined structure and a final reference treatment comprising at least an overaging, the reference heat treatment being defined by an annealing temperature AT, a quenching temperature QT, an overaging temperature $PT_0$ and a holding duration $Pt_0$ at the overaging temperature, said method for producing a high strength steel piece comprising a step of heat treating a steel piece on an equipment comprising at least overaging means in order to obtain the desired mechanical properties for the high strength steel piece, the step of heat treating comprising at least a final treatment made on a steel having a structure similar to the defined structure resulting from said first reference treatment, the final treatment comprising at least an overaging step made on said overaging means for which it is possible to set at least one operating point, for which it is possible to calculate two final treatment parameters OAP1 and OAP2 depending on said at least one operating point of the averaging means, wherein:

the steel piece is a hot formed piece and the overaging means is a furnace in which the piece is maintained, and just before entering in the furnace, the hot formed piece has the same structure as the defined structure resulting from said first reference treatment, and the method comprises the steps of:

determining a minimum first final treatment parameter OAP1 min and a maximum second final treatment parameter OAP2 max respectively, in order to obtain the desired mechanical properties, by performing a plurality of experiments with overaging consisting in a heating from the quenching temperature QT up to a holding temperature Th at a heating speed of more than 10° C./s, a holding step at the holding temperature Th for a plurality of durations tm and a cooling down to the room temperature at a cooling speed higher than 10° C./s and selected so as not to form untampered martensite in the structure at the piece, determining the at least one operating point of the overaging section means such that the first final treatment parameter OAP1 and the second final treatment parameter OAP2 resulting from operating points fulfill:

$$OAP1 > OAP1\ \text{min and}$$

$$OAP2 < OAP2\ \text{max},$$

the operating points which are determined comprising at least one of the following operating points: a holding duration of the piece in the furnace, a heat power and the overaging temperature, and heat treating the piece on the equipment according to the determined operating points, wherein, if T(t) is the temperature in ° C. of the steel piece at the time t, $t_0$ the time of the beginning of the final treatment and $t_f$ the time of the end of the final treatment: the corresponding first averaging parameter OAP1 is:

$$OAP1 = \int_{t_0}^{tf} \exp(-Q/R(T(t)+273))dt,$$

wherein Q=activation energy of the diffusion of carbon and R=ideal gas constant, and the second overaging parameter OAP2 is:

$$OAP2 = a * T_0 + b * \left( \int_{t_0}^{t_f} T(t)^2\, dt \right)^{\frac{1}{2}}$$

$T_0$ being the temperature at time $t_0$, wherein Q=148000 J/mol, R=8.314 J/(mol·K), a=b=0.016 and t is in seconds.

10. The method according to claim 9, wherein the desired mechanical properties are minimum values for at least a traction property and for at least a ductility property.

11. The method according to claim 9, wherein the first reference treatment comprises an annealing at a temperature higher than the Ac1 transformation point of the steel in order to obtain, before quenching, a structure containing at least 50% of austenite, and a quenching down to the quenching temperature QT lower than the Ms transformation point of the steel in order to obtain a structure comprising just after quenching at least martensite and austenite, and the overaging is made at a temperature not less than the quenching temperature QT and lower than the Ac1 transformation point of the steel.

12. The method according to claim 11, wherein the annealing is made at a temperature higher than Ac3 in order to obtain before quenching a structure fully austenitic.

13. The method according to claim 11, wherein the quenching temperature QT is such that the structure resulting from the final treatment contains at least 10% of austenite.

14. The method according to claim 9, wherein the final treatment comprises further to the overaging step, a hot dip coating step.

15. The method according to claim 9, wherein in that the steel has a chemical composition comprising in weight %:

0.1%≤C≤0.5%;
0.5%≤Si≤2%;
1%≤Mn≤7%;
Al≤2%;
P≤0.02%;
S≤0.01%;
N≤0.02%;
optionally one or more elements selected from Ni, Cr, Mo, Cu, Nb, V, Ti, Zr and B, the contents of which being such that:
Ni≤0.5%;
0.1%≤Cr≤0.5%;
Cu≤0.5%;
0.02%≤Nb≤0.05%;
0.02%≤V≤0.05%;
0.001%≤Ti≤0.15%;
0.2%≤Zr≤0.3%;
0.0005%≤B≤0.005%;
with: Nb+V+Ti+Zr/2≤0.2%; and
a remainder being Fe and unavoidable impurities.

* * * * *